United States Patent [19]

Hayama et al.

[11] 4,128,057

[45] Dec. 5, 1978

[54] STENCIL PAPER ASSEMBLY

[75] Inventors: Noboru Hayama, Tokyo; Yoshio Tsuji, Koganei, both of Japan

[73] Assignee: Riso Kagaku Corporation, Tokyo, Japan

[21] Appl. No.: 666,305

[22] Filed: Mar. 12, 1976

[30] Foreign Application Priority Data

| | | | |
|---|---|---|---|
| Mar. 13, 1975 | [JP] | Japan | 50/30475 |
| Apr. 16, 1975 | [JP] | Japan | 50/51306[U] |
| Apr. 24, 1975 | [JP] | Japan | 50/56261[U] |
| Apr. 24, 1975 | [JP] | Japan | 50/56262[U] |

[51] Int. Cl.[2] ..... B41F 15/34

[52] U.S. Cl. ..... 101/128.2; 101/127

[58] Field of Search ..... 101/125, 114, 127, 128.2, 101/128.3, 128.4, 330, 333, 350, 364, 366, 363; 427/143; 282/28 R

[56] References Cited

U.S. PATENT DOCUMENTS

| | | | |
|---|---|---|---|
| 1,101,262 | 6/1914 | Edmonds | 282/28 |
| 1,650,868 | 11/1927 | Gestetner | 101/125 |
| 2,086,011 | 7/1937 | Whitmore | 101/125 X |
| 2,132,719 | 10/1938 | Bright | 101/125 |
| 2,581,153 | 1/1952 | Wallich | 101/125 X |
| 2,651,255 | 9/1953 | Wallich | 101/125 |
| 3,020,836 | 2/1962 | Palmer et al. | 101/125 |
| 3,070,825 | 1/1963 | Martin | 101/363 X |
| 3,561,360 | 2/1971 | Branfield et al. | 101/350 |
| 3,570,396 | 3/1971 | Schwartzman | 101/125 |
| 3,572,243 | 3/1971 | Gronau | 101/125 X |
| 3,694,245 | 9/1972 | Anderson et al. | 101/128.2 X |

FOREIGN PATENT DOCUMENTS

| | | | |
|---|---|---|---|
| 2338717 | 2/1974 | Fed. Rep. of Germany | 101/125 |

*Primary Examiner*—Ronald E. Suter

*Attorney, Agent, or Firm*—Birch, Stewart, Kolasch & Birch

[57] ABSTRACT

A stencil paper assembly comprising a stencil paper sheet and an ink-impermeable sheet laid one over the other, said assembly being adapted to maintain a layer of ink between said stencil sheet and said ink-impermeable sheet so that numerous printed sheets may be obtained with one charge of ink and without causing smearing of ink.

4 Claims, 14 Drawing Figures

STENCIL PAPER ASSEMBLY

BACKGROUND OF THE INVENTION

1. Field of the Invention

The present invention relates to stencil paper and, more particularly, a stencil paper assembly to be conveniently used in a stencil duplicating process.

2. Description of the Prior Art

The stencil paper is conventionally well known in various types such as thermally fusible resin film adapted to be formed with perforations by heat, stencil paper for typewriting, stencil paper adapted to be perforated by impact applied by a ball pen, wax stencil paper which is perforated by impact applied by cooperation of a file plate and a stylus or the like, and facsimile paper adapted to be electrically perforated by sparks due to electric discharge. For the printing process of the prior art employing a stencil paper of any of the aforementioned types, the stencil paper is conveniently mounted to a manual stencil duplicating device wherein the printing ink is applied manually by means of a hand roller or, alternatively, the stencil paper is mounted to a rotary stencil duplicator which is designed to provide a more efficient duplicating process. In any event, stencil printing is one of the most convenient and inexpensive printing processes and has been widely used for many years. However, the prior art stencil printing process has a drawback in that it requires relatively complicated manual work such as stretching a stencil paper sheet to a frame of a stencil duplicating device and applying ink by means of a manual roller or a squeegee, or mounting a stencil paper sheet around a cylinder of a rotary stencil printing machine. Furthermore, in either of the above prior art devices which employ the frame type manual stencil printing device or the rotary printing device, the inked stencil paper sheet must be removed from the printing device or machine by hand and this manual work causes a problem that hands or clothes may be smeared with ink. Because of these prior art problems, both the necessity of operating the stencil printing device skillfully and the problem of smearing hands or clothes with ink, the stencil printing process is slowly becoming less popular.

SUMMARY OF THE INVENTION

Therefore, it is the primary object of the present invention to solve the abovementioned drawbacks in the conventional stencil printing process and to provide a novel stencil paper assembly which enables an unskilled person to perform the stencil printing process easily and conveniently in his office or home without requiring any special printing device.

According to the present invention, the aforementioned object is accomplished by a stencil paper assembly comprising a stencil sheet having a first surface to be supplied with ink and a second surface to contact with a surface to be printed and an ink-impermeable sheet laid over said first surface of said stencil sheet, said stencil sheet and said ink-impermeable sheet being combined with each other at a part of peripheral portions thereof.

It is already known prior art to supply a stencil paper as an assembly comprising a stencil sheet and an auxiliary sheet for the purpose of protecting the stencil sheet from becoming wrinkled or damaged as well as to facilitate the handling of the stencil paper. In the conventional prior art stencil paper assembly, the auxiliary or base sheet is combined with a stencil sheet along an edge portion thereof and is adapted to be torn off before the stencil sheet is mounted to a frame type stencil duplicating device or a rotary printing machine. In more detail, the conventional stencil prior art paper assembly comprising a stencil sheet and an auxiliary or base sheet, the stencil sheet having a first surface to be supplied with ink and a second surface to contact with a surface to be printed is attached to the base sheet with said second surface being laid over said base sheet. This base sheet is obviously superfluous or rather interferes with the printing process if it is left in position and, therefore, it must be torn off before the stencil sheet is mounted to a printing device or machine.

By contrast, the stencil paper assembly according to the present invention comprises an auxiliary sheet which is ink-impermeable in nature and laid over said first surface of the stencil paper sheet which is to be supplied with ink as the operation of this auxiliary sheet is explained in detail hereinafter.

According to an additional feature of the present invention, the stencil paper assembly may further comprise a mounting frame element in the form of substantially a sheet wherein the stencil paper sheet is conveniently attached to one side of said mounting frame element while said ink-impermeable sheet is conveniently attached to the other side of said mounting frame element. By this arrangement, the stencil paper assembly is reinforced to provide a more solid article to be readily handled in the printing process. Furthermore, a sub-assembly made of said mounting frame element and the stencil sheet provides a flat vessel structure having a well space for receiving and accumulating a layer of ink, said sub-assembly cooperating favorably with said ink-impermeable sheet to provide an ink-holding printing plate having a capacity of producing a large amount of printed sheets as explained in more detail hereinafter.

Alternatively, according to another particular feature of the present invention, said ink-impermeable sheet may be formed as a kind of framed sheet having a peripheral frame portion and a central sheet portion supported by said mounting frame portion at its peripheral portion, said central sheet portion being slightly displaced from said mounting frame portion so that a well portion for receiving and holding a layer of ink is provided on one side of said ink-impermeable sheet. In this case, the stencil sheet is attached to said side of the ink-impermeable sheet so that the well space is closed by the stencil paper sheet.

According to still another feature of the present invention, the stencil paper assembly may further comprise a package of ink mounted adjacent to a portion where the stencil sheet and the ink-impermeable sheet are bound to each other. By incorporating such an ink source in the stencil paper assembly, the user may buy the assembly as the only material needed to perform stencil printing and, thus will immediately be able to accomplish the printing process with no need of securing a source of ink.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
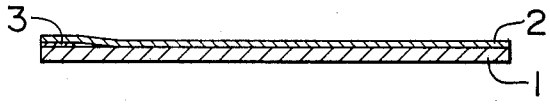
FIG. 1 is a sectional view of a basic embodiment of the stencil paper assembly according to the present invention.

Referring to FIG. 1, a basic embodiment of the stencil paper assembly according to the present invention is shown, wherein reference numerals 1 and 2 designate a stencil sheet and an ink-impermeable sheet, respectively, these two sheets being connected by a binding element 3.

Figure 2:
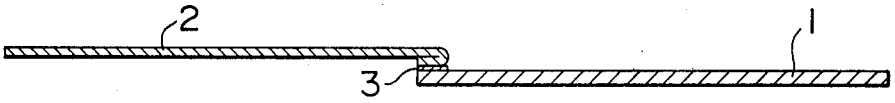
FIG. 2 is a view similar to FIG. 1 but shows the assembly with the ink-impermeable sheet being folded open.
Figure 3:
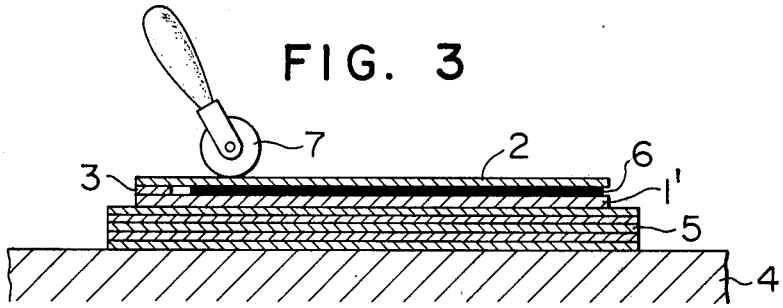
FIG. 3 is a sectional view showing the printing process employing the stencil paper assembly shown in FIGS. 1 and 2.

In performing the stencil printing process by employing the stencil paper assembly according to the present invention, a perforation pattern is formed in the stencil sheet. A particular perforating process is used which is suitable for the particular stencil paper sheet material. Except in the case where the stencil sheet 1 is of a heat sensitive type and the ink-impermeable sheet is transparent, the perforating process uses a ink-impermeable sheet 2 which is folded outward adjacent to the binding portion 3 as shown in FIG. 2. After the perforation pattern has been formed in the stencil sheet, the printing process is performed in the manner as exemplarly shown in FIG. 3. FIG. 3 shows a manner of manual printing, wherein 1' designates the stencil sheet which corresponds to the stencil sheet 1 but is formed with a perforation pattern therein. Upon a base plate 4 are stacked a plurality of paper sheets 5 to be printed. Numeral 6 designates a layer of printing ink supplied between the perforated stencil sheet 1' and the ink-impermeable sheet 2. Numeral 7 is a conventional printing roller.

The printing structure as shown in FIG. 3 is obtained by first placing a stack of paper sheets 5 on the base plate 4, secondly placing the stencil paper assembly upon the stack of paper sheets, thirdly supplying ink upon the perforated stencil sheet 1' by provisionally taking up the ink-impermeable sheet 2, fourthly placing the ink-impermeable sheet 2 upon a relatively uneven layer of ink and finally applying a flattening action by the roller 7. Upon the first application of a rolling action, the uppermost paper sheet is printed. Thereafter, by removing each uppermost paper as it is printed, the stacked paper sheets are successively printed. As apparent from the printing structure shown in FIG. 3, since the ink forming the ink layer 6 is confined between the perforated stencil sheet 1' and the ink-impermeable sheet 2, there is no danger that hands or clothes are inadvertently smeared with ink even when they come into contact with the upper surface of the stencil paper assembly or the hand roller 7 which does not carry an ink layer by contrast to the conventional method.

By applying a pressure onto the ink-impermeable sheet 2 by means of the roller 7, the ink in the ink layer 6 is transferred through the perforations formed in the stencil sheet onto the paper sheet 5 and a clear print figure is obtained on the paper sheet. Alternatively, the printing pressure may be applied at the back side of the paper sheet 5 by turning the stacked-up structure shown in FIG. 3 upside down. Since an ink layer 6 of a substantial thickness can be held between the stencil sheet 1' and the ink-impermeable sheet 2, a relatively large number of sheets can be printed without supplementing the ink during the printing process. The ink-impermeable sheet 2 may be either transparent or opaque. For example, the plastic sheet may be made of various kinds of plastic film or sheet, metal foil, glass or parchment paper, oil paper, wax paper, treated papers such as synthetic paper, cloths treated with resin which are impermeable to the printing ink. When the stencil sheet is a heat sensitive type, it is desirable that the ink-impermeable sheet is transparent because in this case, the perforating process for the stencil sheet is performed without folding the ink-impermeable sheet 2 outward as shown in FIG. 2. In other words, the stencil paper assembly with the two sheets assembled as shown in FIG. 1 may be directly placed upon an original carrying a pattern printed with ink including a light absorbing material such as carbon black and a light beam generated by, for example, a tungsten incandescent lamp, xenon flash lamp, photoflash bulb or the like. By applying the light beam thereupon through the transparent ink-impermeable sheet, the light beam is thus absorbed by the printing ink forming the pattern of the original thereby generating heat or a heat pattern corresponding to the ink printed pattern of the original. The heat pattern selectively melts the heat sensitive stencil sheet so as to generate a corresponding perforation pattern therein. In this case, therefore, the necessity of folding the ink-impermeable sheet 2 outwardly as shown in FIG. 2 is eliminated and the perforating process is simplified.

The stencil sheet may be of any conventional type such as, for example, heat sensitive stencil paper, typewriting stencil paper, ball pen stencil paper, wax stencil paper, facsimile stencil paper or the like. Furthermore, a punched pattern sheet may also be employed in the stencil paper assembly according to the present invention. The binding element or portion 3 may be made of any suitable binding agent such as synthetic resin binding agents or paste. Alternatively, the binding element may be a staple. The binding portion or element may be positioned at any convenient portion, preferably along an edge of a rectangular sheet.

Several examples of the present invention are given as follows.

EXAMPLE 1

A stencil sheet was prepared from an oriented resin film of vinylidene chloride-vinyl chloride copolymer, trademark "Saran" film, produced by Asahi-Dow Limited, and an ink-pervious polous substrate (tissue paper) principally made of manila hemp having weight per unit area of $10g/m^2$, these two sheets being joined together by polyvinyl acetate type adhesive. Onto the tissue paper the stencil sheet was laid and an edge of a transparent polystyrene sheet being 75 micron thick, trademark "Styrosheet" produced by Asahi-Dow Limited, was bound to the stencil sheet by a commercially available polyvinyl acetate type adhesive, thus providing the stencil paper assembly. This stencil paper assembly was laid over a newspaper clipping with the heat sensitive film surface thereof contacting the clipping and a flash light was applied from the upper side through said transparent ink-impermeable sheet by employing an electronic light flashing means having xenon flash discharge tubes, trademark "Xenofax" manufactured by Riso Kagaku Corporation. By this exposure to the light beam, the perforation pattern corresponding to the printed pattern on the newspaper clipping was generated in the Saran film due to the heat generated in the printed pattern. Then a sheet was placed on a flat plate and thereupon the stencil paper assembly was placed with said film surface contacting the paper sheet. Then an emulsion ink for stencil printing which was especially prepared to be relatively hard or to have relatively low fluidity was supplied between the tissue paper surface of the stencil sheet and the ink-impermeable sheet having weight per unit area of $60g/m^2$. By applying a light rolling action to the upper surface of the ink-impermeable sheet, ink passed through the perforated portions of the stencil sheet and was transferred onto the printing paper sheet thereby producing a sheet of printed matter. The printed paper was successively removed while continuing the printing process. In this manner, by the initial charge of the printing ink, 80 pieces of clearly printed sheets were obtained. The hands and clothes of the operater were not smeared at all with ink.

EXAMPLE 2

A conventional typewriting stencil paper was utilizing in a stencil typewriting action in a Japanese letter typewriter equipped with number 8 types. A polyethylene film being 10 micron thick was used as the ink-impermeable sheet which was laid over the typewritten stencil paper. These two sheets were bound together along one edge thereof by the aforementioned polyvinyl acetate type adhesive to form the stencil paper assembly. A printing paper sheet was placed on a flat plate and thereupon said stencil paper assembly was laid with said typewritten stencil paper contacting the printing paper sheet. Then the same ink as used in Example 1 was supplied between the typewritten stencil paper and the ink-impermeable sheet made of the paper coated with the polyethylene emulsion. By applying rolling action onto the ink-impermeable sheet, the printing process was performed. Thus, clearly printed sheets were obtained and the stencil paper assembly did not result in the smearing of hands or clothes with ink.

EXAMPLE 3

A commercially available fascimile stencil paper (electronic stencil paper manufactured by Tomoegawa Paper Company) was used to produce a perforated-stencil paper according to electric discharge based upon an offset printing original. Upon this perforated stencil paper, an ink-impermeable sheet made of a polystyrene synthetic paper being 15 micron thick, "Upo FP" produced by Mitsubishi Seishi Kabushiki Kaisha, was laid and bound thereto by an adhesive along an edge thereof thereby providing the stencil paper assembly. After an oil printing ink was supplied between the stencil sheet and the ink-impermeable sheet, the two sheets were firmly bound together along the other two edges by employing cellophane tape to prevent the escape of the oily printing ink. By employing this stencil paper assembly containing the printing ink, the printing process was performed. As a result, clearly printed sheets as in Example 1, were obtained without causing the problem of smearing the surroundings with ink.

EXAMPLE 4

A 7 micron thick oriented film of vinylidene chloride-vinyl chloride copolymer resin film, trademark "Saran" film produced by Asahi-Dow Limited, was bound together with a screen of 70 mesh of polyster fibre by employing a polyvinyl acetate type adhesive to provide the stencil sheet. On the screen side of the aforementioned stencil sheet, which was cut to the size of 30cm × 21cm, was laid a 22 micron thick water proof cellophane paper of the same size and bound thereto by the polyvinyl acetate type adhesive along an edge thereof for a strip width of about 1cm, thus providing the stencil paper assembly. This stencil paper assembly was laid upon a type printed original having a black ink pattern with said resin film contacting the original and a light beam was flashed over the assembly through the transparent cellophane paper by employing the same electronic flash light-means as employed in Example 1. By this exposure to the light beam, a perforation pattern corresponding to the printed pattern was formed in the film by the heat generated in the printed portions of the original. A red dying paste was supplied between the stencil paper sheet and the cellophane paper and the assembly was placed on a white silk cloth extended over a flat plate. Then a light squeezing action was applied onto the cellophane paper by employing a squeegee. As a result, the dying paste was transferred through the perforated portions of the stencil sheet onto the silk cloth, on which a clear dye pattern was obtained. Because the cellophane paper was used, no trouble of smearing by the dying paste was encountered.

EXAMPLE 5

A commercially available wax stencil paper was placed on a file plate and a perforating process was applied by writing letters thereupon by use of a stylus.

A treated paper made of a 12 micron thick aluminum foil and a paper having a weight per unit area of $30g/m^2$ were pasted together and laid over the aforementioned wax stencil sheet and cut to the size of 30cm × 21cm. The two sheets were bound together along an edge thereof for a strip width of about 1cm by employing an adhesive. Along the two longer edges, a strip portion of about 1cm width was folded toward the stencil paper side thereby forming an envelope. Approximately 60g of the same printing ink as was used in Example 3 was supplied into the envelope through its open end. This enveloped stencil paper assembly was placed on a printing paper sheet with said wax stencil paper contacting the printing paper and a light rolling action was applied thereupon. By successively removing the uppermost printing paper, 150 pieces of printed sheets were obtained, all in clearly printed condition.

EXAMPLE 6

A heat sensitive stencil sheet made of an ink-permeable porous tissue paper impregnated with resin, trademark "Gestetner Therman 400" produced by Gestetner Limited, was closely laid upon an original made of a high quality paper on which letters are written by employing a writing brush and indian ink. The film surface of the stencil sheet contacts the original, and then a light beam from a tungsten incandescent lamp was applied from the tissue paper side by employing a commercially available thermocopying machine, trademark "Risofax" manufactured by Riso Kagaku Corporation, thereby producing a perforated stencil sheet. Upon this stencil sheet, a non-woven cloth, trademark "Vilene 520" produced by Japan Vilene, was laid. The non-woven cloth was then sufficiently impregnated with ink for use with cardboard MD-4 Black, produced by Teikoku Ink Kabushiki Kaisha, and thereupon a commercially available paraffin paper was laid, thus providing the stencil paper assembly. The assembly was laid upon a cardboard with the stencil paper sheet contacting the cardboard and a light rolling action was applied onto the paraffin paper. By this printing process, clearly printed sheets were obtained without causing the problem of ink smearing.

EXAMPLE 7

A heat sensitive stencil sheet made of a vinylidene chloride type film and a tissue paper bound together, trademark "Risomaster" produced by Riso Kagaku Corporation, and an ink-impermeable sheet made of a 50 micron thick hard type vinyl chloride resin were joined together along an edge thereof with said ink-impermeable sheet contacting the tissue paper side of the stencil sheet, thus providing the stencil paper assembly. The combination of the two sheets was made by duel surface adhesive tape. A plain paper xerographic copy was laid onto the vinylidene chloride-vinyl chloride copolymer resin film surface of the stencil sheet as an original and an infra-red ray beam was applied from the side of the hard type vinyl chloride resin sheet by employing the same thermal copying machine as employed in Example 6, thereby providing a perforated stencil sheet. About 50g of ink for use with screen printing, trademark "Q-set Ink" produced by Jujo Kako Kabushiki Kaisha, was supplied between the perforated stencil sheet and the ink-impermeable sheet and then the two sheets were bound together along the remaining three edges by employing dual surface adhesive tape thereby preventing the escape of ink therefrom. The stencil paper assembly thus prepared was laid upon a flat desk surface with its stencil paper surface facing upward. Thereupon a high quality paper for use as a poster was laid thereunder and a uniform pressing action was applied thereupon. By this printing process, clearly printed sheets were obtained.

Figure 4:
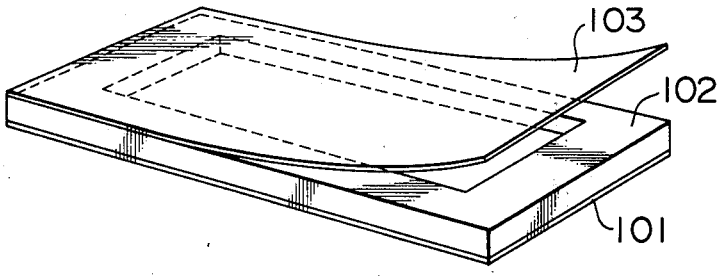
FIG. 4 is a perspective view showing another embodiment of the stencil paper assembly according to the present invention.

Referring to FIG. 4 which shows another embodiment of the stencil paper assembly according to the present invention, a heat sensitive stencil sheet 101 is attached to one surface of a mounting frame element 102 in a manner that the first surface of the stencil sheet to be supplied with ink contacts said one surface of the mounting frame element. At the other side of the mounting frame element 102 is attached a transparent ink-impermeable sheet 103.

Figure 5:
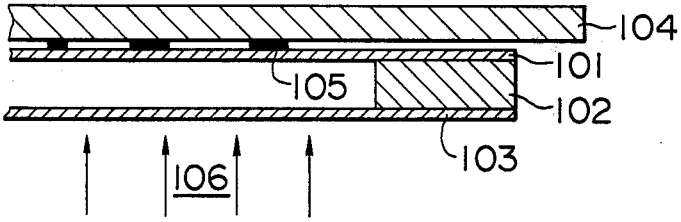
FIG. 5 is a sectional view showing the manner of forming perforation patterns in the stencil paper assembly shown in FIG. 4.

FIG. 5 shows the manner of performing the perforating process for the stencil paper assembly as shown in FIG. 4. As shown in FIG. 5, an original 104 carrying figure portions 105 is closely contacted with the heat sensitive stencil sheet 101 and a light beam 106 is applied from the side of the transparent ink-impermeable sheet 103. The light beam absorbed by the figure portion 105 generates heat therein, said heat melting the corresponding portions of the heat sensitive stencil sheet 101 thereby perforating the corresponding portions thereof.

Figure 6:
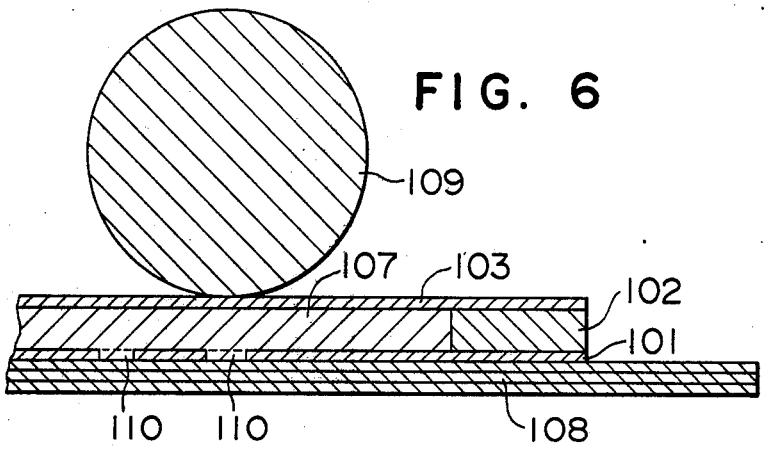
FIG. 6 is a sectional view showing the printing process employing the stencil paper assembly shown in FIGS. 4 and 5.
Figure 7:
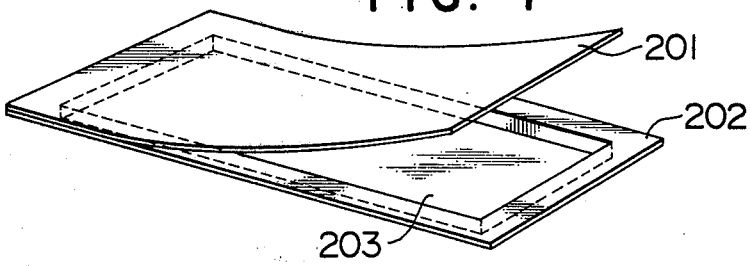
FIG. 7 is a perspective view showing still another embodiment of the stencil paper assembly according to the present invention.
Figure 8:
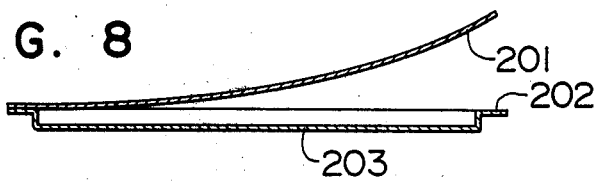
FIG. 8 is a sectional view of the stencil paper assembly shown in FIG. 7.

FIG. 6 shows exemplary the manner of performing the printing process by employing the stencil paper assembly prepared in the aforementioned manner. The assembly is supplied with a layer of ink 107 between the perforated stencil sheet 101 and the ink-impermeable sheet 103. The assembly is placed upon a stack of printing paper sheets 108 and rolling action is applied onto the ink-impermeable sheet 103 by means of a pressing device such as a roller 109. By application of this pressure, the ink forming the layer 107 is urged through perforated portions 110 of the heat sensitive stencil sheet 101 and transferred onto the printing paper sheet 108 thereby providing a sheet of printed matter. In the printing structure shown in FIG. 6, the pressing action by the roller 109 or the like may also be applied from the lower side or the printing paper side instead of being applied from the upper side or the ink-impermeable sheet side.

As apparent from FIG. 6, since the layer of ink 107 is positively held in the space confined by the stencil sheet 101, the ink-impermeable sheet 103 and the mounting frame element 102, a relatively thick layer of ink can be provided without causing the problem of ink leaking out from the stencil paper assembly. Therefore, this embodiment enables us to obtain a larger number of printed sheets by use of one charge of ink when compared with the basic embodiment as shown in FIG. 1.

The heat sensitive stencil sheet 101 may be of any conventional type such as a sheet made of thermoplastic synthetic resin film and ink-permeable porous substrate bound with each other, perforated sheet material impregnated with wax, etc.

The ink-impermeable sheet 103 may be of the same type as explained with reference to the basic embodiment shown in FIG. 1 provided that it is substantially transparent. A sheet of this kind is obtained, for example, from polypropylene, polystyrene, polyester, polycarbonate or similar transparent synthetic resin. Furthermore, a relatively transparent water and oil-proof paper such as cellophane, parchment paper is also employable.

The mounting frame element 102 should preferably be made of a sheet having a proper rigidity and a uniform thickness in order to accomplish a uniform tone in printing and to facilitate handling of the assembly in the printing process. A favorable frame element may be obtained from, for example, paper, plastic, metal, wood, etc. The thickness of the frame element may be designed to provide a required ink holding capacity and may preferably be in the range of 0.5–5mm.

An example of this second embodiment is given below.

EXAMPLE 8

The stencil sheet was prepared from a 7 micron thick oriented vinylidene chloride-vinyl chloride copolymer resin film, trademark "Saran" film produced by Asahi-Dow Limited, and a tissue paper principally made of manila hemp having a weight per unit area of $10g/m^2$, these sheets being joined by polyvinyl acetate type adhesive. On the other hand, a mounting frame element was prepared from a 0.8mm thick cardboard to have an outside dimension of 16 × 21cm and an inside or opening dimension of 10 × 15cm. This annular element was attached to the tissue paper side of said stencil sheet by employing the aforementioned adhesive. At the other side of the annular frame element was attached a transparent polystyrene sheet being 15 micron thick, Trademark "Styro-film" produced by Asahi-Dow Limited, thus providing a heat sensitive stencil paper assembly. By applying a newspaper clipping in close contact to the heat sensitive stencil sheet of this assembly, a flash light was applied from the side of said polystyrene sheet by employing an electronic flashlight means equipped with a xenon discharge tube, trademark "Xenofax" manufactured by Riso Kagaku Corporation. By this flashlight exposure, a perforation pattern corresponding to the printed pattern of the newspaper clipping original was formed in the stencil sheet of the assembly. The polystyrene sheet was then lifted and about 13g of emulsion ink for stencil printing, trademark "Riso Ink # 2000" produced by Riso Kagaku Corporation, was supplied onto the stencil sheet within the range of the mounting frame element. Then the polystyrene sheet was closed thereupon to spread the ink over the entire region within the mounting frame by roller action applied upon the polystyrene sheet. The assembly is then placed upon a high quality paper and pressure was applied to the assembly. As a result, 80 pieces of clearly printed sheets were obtained. The ink was perfectly contained within the range defined by the mounting frame element and the stencil paper assembly did out result in the smearing of hands or clothes of the operator or his surroundings with ink.

A third embodiment of the stencil paper assembly according to the present invention will now be explained with reference to FIGS. 7–10. In this embodiment, a heat sensitive stencil sheet 201 is assembled with an ink-impermeable sheet 202 formed by pressing from a thermo-plastic resin to have a well portion 203 for maintaining an ink supply source.

Figure 9:
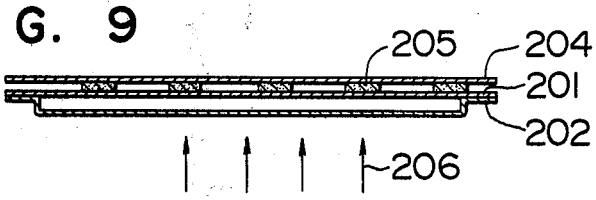
FIG. 9 is a sectional view showing the manner of forming perforation patterns in the stencil paper assembly shown in FIGS. 7 and 8.

FIG. 9 shows the manner of forming a perforation pattern in the stencil sheet 201 of this assembly. As shown in FIG. 9, an original 204 carrying printed patterns 205 made of an infra-red ray absorbing material and the stencil paper assembly are stacked together with the stencil sheet 201 contacting the printed surface of the original. A light beam 206 is then applied from the side of the ink-impermeable sheet 202, whereby a perforation pattern corresponding to the printed pattern is formed in the stencil sheet 201 by the heat generated in the printed portions of the original.

Figure 10:
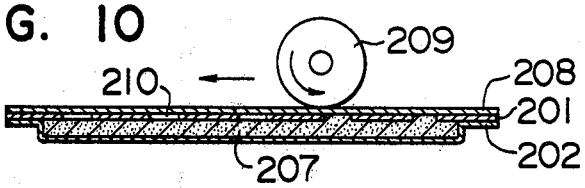
FIG. 10 is a sectional view showing the printing process employing the stencil paper assembly shown in FIGS. 7–9.

FIG. 10 shows exemplarly a manner of performing the printed process by employing the perforated stencil paper assembly prepared in the manner shown in FIG. 9. Ink is charged into the well portion 203 of the ink-impermeable sheet 202 so that an ink layer 207 is formed in the well portion. As shown in FIG. 10, the stencil paper assembly is placed on a flat surface (not shown) and its stencil sheet 201 facing upward and a printing paper 208 is placed thereon. Then, the printing pressure is applied by a roller 209 from the upper side of the printing paper 208, whereby the ink forming the ink layer 207 is urged upward through the perforations 210 formed in the stencil sheet and transferred onto the lower surface of the printing paper 208. The heat sensitive stencil sheet 201 may be of any conventional type such as a combination of an oriented thermoplastic synthetic resin film and an ink-permeable porous substrate bound with each other, a perforated stencil paper impregnated with resin, wax or the like, etc., provided that the stencil sheet is adapted to cause perforations when it has been selectively heated. The ink-impermeable sheet 202 should preferably be moulded from a tough and highly mouldable thermo-plastic synthetic resin sheet of about 50–200 micron in thickness such as a sheet of polystyrene, polyvinyl chloride, polycarbonate, polypropylene, polyester (e.g., polyethylene terephtalate) or the like, so as to provide a well portion of a required depth. The ink-impermeable sheet 202 should preferably be transparent so that the light beam is applied therethrough without folding the sheet outward when the perforating process of the stencil paper sheet is performed. The depth of the moulded well portion may vary according to the sheet material used and the sort of printing and may preferably be approximately in the range of 0.1–5 mm. The shape or contour of the well portion may properly be determined in accordance with the shape or area of printing. Furthermore, the moulded bottom surface of the well portion may be formed with a proper embossment according to a lattice or other pattern. By this modification, the ink holding performance of the stencil paper assembly is improved under the application of the printing pressure exerted by a roller. Furthermore, it becomes possible to separate a region of the well space from another by a rubber string or the like so that the individual regions are charged with ink of different colors thereby accomplishing a simultaneous multicolors printing.

The ink-impermeable sheet moulded to have the well portion and the heat sensitive stencil paper assembly are bound with each other at a part of their peripheral portions generally by an adhesive dual surface adhesive tape, etc. The binding of the stencil sheet with the ink-impermeable sheet may be done after the stencil sheet has been applied with the perforating process and the ink-impermeable sheet has been charged with ink. The binding of the two sheets may be made at a part or entire region of their peripheral portions.

Several examples with respect to this third embodiment are given below.

EXAMPLE 9

The ink impermeable sheet was moulded from a polystyrene sheet being 120 micron thick and having the rectangular dimensions of 120 × 170 mm to form a central well portion of 1 mm deep and having the rectangular dimension of 100 × 150 mm. This ink-impermeable sheet was stacked together with a heat sensitive stencil sheet, a laminated sheet of vinylidene chloride-vinyl chloride copolymer resin film and an ink-permeable porous substrate, trademark "Risomaster" produced by Riso Kagaku Corporation, by dual surface adhesive tape along two edges thereof thereby providing the stencil paper assembly. Upon the stencil sheet of this assembly was laid a newspaper clipping being 9 cm × 14 cm in size and a flash light was applied from the side of the polystyrene ink-impermeable sheet by employing a thermal copying machine, trademark "Xenofas" manufactured by Riso Kagaku Corporation, thereby forming a perforation pattern in the stencil sheet according to the printed original of the newspaper clipping. Then, about 20g of black emulsion ink for printing purposes was charged into the well portion and the ink containing stencil paper assembly was prepared. A medium quality paper cut to the size of the postcard was laid upon the assembly and the rolling action was applied to the back of the printing paper by employing a roller of 25 mm diameter and 90 mm length. Approximately 50 pieces of printed sheets were successively printed and all pieces showed clearly printed surfaces. The printing process was very easily performed and the assembly did not result in the smearing of hands or clothes of the operator with ink.

EXAMPLE 10

The same ink-impermeable sheet as that in Example 8 was prepared from the polystyrene sheet provided that, in this case, the well portion was formed with a lattice mould pattern of 1 mm strip width, 0.5 mm depth and 2 mm spacing. This ink-impermeable sheet was stacked together with the same heat sensitive stencil sheet as used in Example 8 by means of dual surface adhesive tape thus providing a heat sensitive stencil paper assembly. The stencil sheet of this assembly was formed with a perforation pattern according to the same process as applied to Example 8 and then the pad portion was separated into two regions by putting therein a partition made of a plastic rod of 1 mm square section so that one section was charged with about 8g of blue emulsion ink for stencil printing and the other with about 8g of red emulsion ink for stencil printing. The printing process was performed in the same manner as in Example 8 and 30 pieces of printed sheets were obtained in clearly printed condition. The operation was very easy and the stencil paper assembly did not result in the smearing of the surroundings with ink.

EXAMPLE 11

The ink-impermeable sheet was prepared by moulding process from a hard type vinyl chloride sheet to have dimensions of 70 micron in thickness and having the rectangular dimensions of 220 × 300 mm, wherein the central well portion was 0.5 mm deep and having the rectangular dimensions of 200 × 280 mm. This ink-impermeable sheet was stacked together with a heat sensitive stencil sheet (a combination of 7 micron thick vinylidene chloride - vinyl chloride copolymer resin film and 70 mesh polyestel screen) and these two sheets were bound by a polyvinyl acetate type adhesive along two edges with the ink-impermeable sheet contacting the screen surface of the stencil sheet. The stencil paper assembly thus prepared was closely laid over an original which was a film carrying a pattern made of indian ink and an infra-red ray beam was applied from the side of the ink-impermeable sheet by employing a thermal copying machine, trademark "Risofax" manufactured by Riso Kagaku Corporation. Thus, a perforated pattern corresponding to that of the original was formed in the stencil sheet of the assembly. Then, about 20g of a blue dye paste was charged into the well portion of the assembly and the stencil sheet and the ink-impermeable sheet were bound together along two edges by dual surface adhesive tape.

Then a printing cotton cloth was placed on a wooden desk and thereupon the stencil paper assembly prepared in the abovementioned manner to contain a layer of blue dye paste was positioned thereover. Then, by applying printing pressure to the ink-impermeable sheet made of the hard type vinyl chloride, 10 pieces of printed sheets were successively obtained. All pieces showed a uniformly clearly printed figure. The operation was very easy and the stencil paper assembly did not result in the smearing of the operator's hands or surroundings with ink.

EXAMPLE 12

The ink-impermeable sheet was prepared by moulding from a lean blue colored polypropylene sheet to be 60 micron thick having the rectangular dimensions of and 120 × 170 mm wherein the central well portion was 1 mm deep and having the rectangular dimensions of 100 × 150 mm. On the other hand, a heat sensitive stencil sheet (ink-permeable porous substrate impregnated with resin wax, trademark "Gestetner thermal 400" produced by Gestetner Limited) was applied with a perforation process by employing the same thermal copying machine as used in Example 11 using an original produced by a plain paper xerographic copying machine.

Then, about 15g of an oily ink for stencil printing was uniformly charged into the well portion of the abovementioned ink-impermeable sheet. This ink-impermeable sheet and the perforated stencil sheet were bound together at four edges thereof thereby forming a stencil paper assembly containing a source of ink. Upon this stencil paper assembly was laid the same printing paper as used in Example 9 and squeezing action was applied onto the printing paper by means of a wooden spatula thereby effecting printing performance. As a result, well conditioned printed sheets as obtained in Example 9 were obtained.

Figure 11:
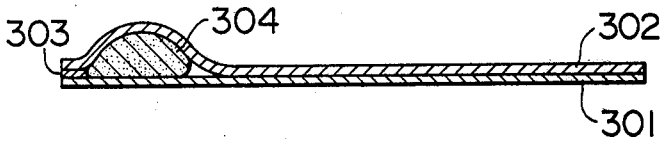
FIG. 11 is a sectional view showing still another embodiment of the stencil paper assembly according to the present invention.

FIG. 11 shows still another embodiment of the stencil paper assembly according to the present invention. This stencil paper assembly comprises a stencil sheet 301 and an ink-impermeable sheet 302 bound with each other by a binding element 303 in the same manner as in the basic embodiment shown in FIG. 1. However, the embodiment shown in FIG. 11 further comprises a source of ink 304 provided between the stencil sheet 301 and the ink-impermeable sheet 302 adjacent one end thereof the sheets being bound together by a binding element 303. The ink source 304 may be a bag containing a lump of ink, said bag being made of a relatively weak sheet material which is readily broken when pressure is applied.

Figure 12:
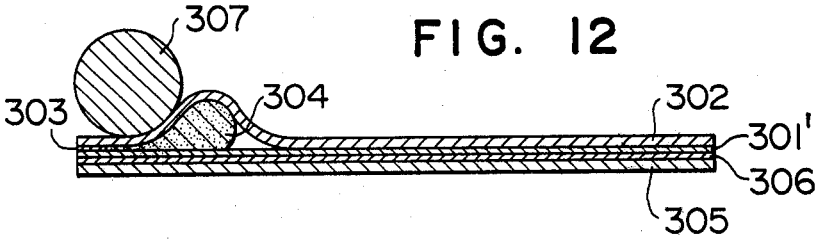
FIG. 12 is a view similar to FIG. 11 but shows the manner of utilizing an ink source incorporated in the stencil paper assembly, and, FIGS. 13 and 14 are perspective views showing two embodiments of the stencil paper assembly having an ink source incorporated therein.

In performing the printing process by employing this stencil paper assembly, the stencil sheet 301 is first formed with a perforation pattern in accordance with a proper perforating process depending upon the material thereof. Then, as shown in FIG. 12, the stencil paper assembly is placed upon a printing sheet material 306 laid on a flat panel 305 with the stencil sheet 301' formed with a perforation pattern contacting the printing sheet material. Then, by employing a printing pressure applying means like a roller 307, pressure is applied to the ink source 304 to open its package and supply ink thereby spreading it over the perforated stencil paper sheet 301' by means of the spreading action applied via the ink-impermeable sheet 302. During this ink spreading process, the ink is also transferred through the perforation pattern formed in the stencil and the corresponding pattern is printed on the sheet material 306. Thereafter, successive printing process may be performed.

Figure 13:
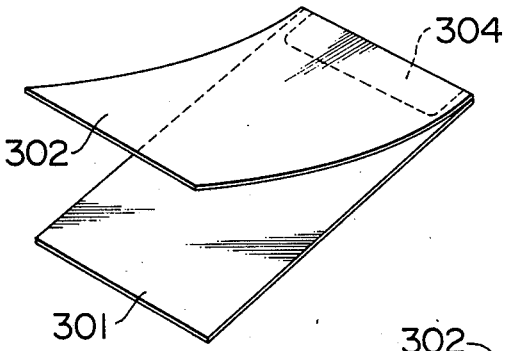
Figure 14:
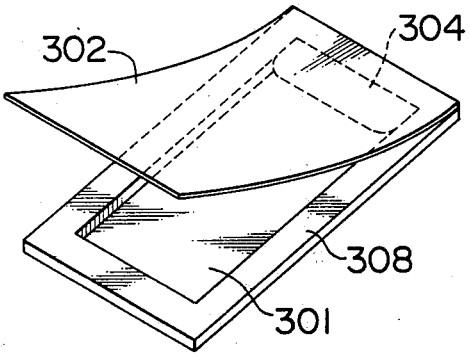

FIG. 13 shows an embodiment of the stencil paper assembly corresponding to the sectional view shown in FIG. 11. FIG. 14 shows another embodiment having the ink source 304 wherein a mounting frame sheet element 308 is further incorporated. By the provision of the mounting frame element the ink spreading region is positively restricted and leaking or escaping of ink from edge portions is positively prevented.

The sheet material to form the bag for the ink source 204 may be constructed of various kinds of plastic sheets, metal foil, glass or parchment paper, oil paper, wax paper, synthetic paper, treated paper, such as polylaminate paper, non-woven cloth treated with ink-impermeable resin, etc. The bag is designed to have a predetermined strength against pressure so that it is broken when the pressure exceeding the predetermined limit is applied. In order to facilitate breakage of the bag, it may be formed with a weakened portion to initiate leakage. Especially when the stencil sheet is of a heat sensitive type and the ink-impermeable sheet is transparent, the bag may preferably be made of a heat sensitive resin material and designed to have a portion which may be applied with a light beam during the perforation process applied to the stencil sheet so that a part of the bag is thermally weakened or perforated thereby facilitating opening of the bag.

Examples of this embodiment are given below.

EXAMPLE 13

A heat sensitive stencil sheet was prepared from an oriented 7 micron thick vinylidene chloride-vinyl chloride copolymer resin, trademark "Saran" film produced by Asahi-Dow Limited, and a tissue principally made of manila hemp having weight per unit area of $10g/m^2$ bound together by a polyvinyl acetate type adhesive. This stencil sheet was attached to one side of a mounting frame element made of a 0.8 mm thick cardboard having outer dimension of 13 cm × 18 cm and inner dimension of 10 cm × 15 cm by use of the abovementioned adhesive with the tissue paper side contacting the frame element. On the other hand, a 14 micron thick vinylidene Chloride-vinyl chloride copolymer resin film of 2.5 cm × 10 cm was made into a bag to contain 15 cc of a printing ink, trademark "Riso Ink # 2000," produced by Riso Kagaku Corporation, thereby providing an ink source. This ink source was attached to a 50 micron thick transparent polystyrene sheet, trademark "Styro Film" produced by Asahi-Dow Limited, by employing dual surface adhesive tape. This combination of the ink source and the transparent polystyrene sheet was attached to the other side of the mounting frame element in a manner that an edge portion of the transparent polystyrene sheet is bound with the frame element with a longer edge of the ink source bag being arranged along a shorter inner edge of the mounting frame element.

Then, a newspaper clipping was laid upon the film surface of the stencil sheet and a flash light beam was applied from the side of the transparent polystyrene sheet by employing an electronic flashlight means having xenon flash discharge tubes, trademark "Xenofax" manufactured by Riso Kagaku Corporation. As a result, a perforation pattern corresponding to the printed pattern of the newspaper clipping was formed in the stencil sheet and, at the same time, the ink bag was opened and ink was spread over the ink-permeable porous substrate of the stencil sheet. The stencil paper assembly thus prepared was placed on printing paper with the film side of the stencil sheet contacting the printing paper and printing pressure was applied onto the transparent polystyrene sheet by a printing roller. According to this process, 100 pieces of printed sheets were obtained, all in clearly printed condition. The printing process was very easy to perform and the stencil paper assembly did not result in the smearing of the surroundings with ink.

EXAMPLE 14

An ink source bag was prepared from an aluminum foil of 20 micron in thickness and having a rectangular dimension of 4 cm × 10 cm as a bag material containing 15g of oily ink for stencil printing, the bag being sealed by cellophane adhesive tape. This ink source bag was sandwiched between edge portions of a commercially available wax stencil paper and a 22 micron thick waterproof collophane paper and these three elements were bound together by an adhesive thereby providing a stencil paper assembly. The wax stencil paper was then placed upon a file plate and letters were written thereon by employing a stylus. Then, the stencil paper assembly was placed upon a printing paper with the wax stencil paper contacting the printing paper and pressure was applied to the ink source bag via said waterproof cellophane sheet by employing a printing roller thereby opening the ink bag and spreading ink therefrom over the wax stencil paper. In this process, the ink was transferred through the perforated portions of the wax stencil paper onto the printing paper. Approximately 60 pieces of printed sheets were successively obtained and all pieces showed a clearly printed figure. The printing process was also very easy to perform and no trouble of ink smearing occured.

EXAMPLE 15

An ink source bag was prepared from a 20 micron thick polypropylene film of size 4 cm × 10 cm and being formed with a linear cut of about 15 micron deep along a longer edge thereof, the bag being charged with 15g of oily ink for stencil printing. The bag was sealed by cellophane adhesive tape. This ink source bag was sandwiched between end portions of a commercially available ball pen stencil paper and a polystyrene sheet similar to that used in Example 13 and these three elements were bound together by an adhesive thereby providing a stencil paper assembly. Then, letters were written on the ball pen stencil sheet by employing a ball pen. The stencil paper assembly was then placed upon a printing paper with the ball pen stencil paper contacting the printing paper and pressure was applied in the same manner as in Example 13. Approximately 60 pieces of printed matter were successively obtained, all showing a clear and uniform printed figure. The printing process was very easy to perform and the stencil paper assembly did not result in the smearing of hands or clothes of the operator with ink.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A stencil paper assembly comprising:

a stencil sheet, an ink-impermeable sheet and a frame sheet element interleaved between said stencil sheet and said ink-impermeable sheet;

said stencil sheet being connected to said frame sheet element at least at a part of peripheral portions thereof while said ink-impermeable sheet is connected to said frame sheet element only at a part of peripheral portions thereof;

said stencil sheet and said ink-impermeable sheet defining with interposition of said frame sheet element a space therebetween for retaining a relatively viscous liquid ink substance sandwiched by the stencil sheet and said ink-impermeable sheet without the use of a pad or other porous carrier.

2. A stencil paper assembly as claimed in claim 1, further comprising an ink-source pack mounted between said stencil sheet and said ink-impermeable sheet, said pack being adapted to be readily broken when a pressure of a predetermined intensity is applied thereto.

3. A stencil paper assembly as claimed in claim 1, wherein said stencil sheet is a thermally perforable stencil sheet while said ink-impermeable sheet is transparent.

4. A stencil paper assembly as claimed in claim 3, further comprising an ink-source pack mounted between said stencil sheet and said ink-impermeable sheet, said pack being adapted to be readily broken when a pressure of a predetermined intensity is applied thereto.

* * * * *